United States Patent [19]

Foley, Jr.

[11] 4,129,088

[45] Dec. 12, 1978

[54] DIVIDED CAP HINGE BRACKET

[75] Inventor: John D. Foley, Jr., Shreveport, La.

[73] Assignee: Ram-Trol, Inc., Bossier City, La.

[21] Appl. No.: 791,171

[22] Filed: Apr. 27, 1977

[51] Int. Cl.[2] ..... B63H 15/12

[52] U.S. Cl. ..... 115/18 E; 115/17; 248/4

[58] Field of Search ..... 115/17, 18 R, 18 E; 248/4, 230; 403/234, 235, 237

[56] References Cited

U.S. PATENT DOCUMENTS

| | | | |
|---|---|---|---|
| 743,964 | 11/1903 | Weir | 403/235 X |
| 1,801,612 | 4/1931 | Pierce | 115/18 R |
| 3,245,642 | 4/1966 | Dicke | 248/230 |
| 3,930,461 | 1/1976 | Brock et al. | 115/18 E X |

*Primary Examiner*—Trygve M. Blix
*Assistant Examiner*—Sherman D. Basinger
*Attorney, Agent, or Firm*—Hill, Gross, Simpson, Van Santen, Steadman, Chiara & Simpson

[57] ABSTRACT

An outboard electric trolling motor has a motor unit comprising a control head, pivot tube, and submersible drive carried in a hinge bracket at the bow of a boat. The hinge bracket is linked by lever arms to the boat for swinging the motor unit from a forward, operating position to a raised, rearward storage position. In a remote control embodiment, the control head and a hinge tube are carried non-rotatably by the hinge bracket with the pivot tube and drive carried rotatably with respect thereto for steering the boat. In a tiller embodiment, the control head is affixed to the pivot tube and the entire motor unit is rotatable in the hinge bracket for steering. The hinge bracket is provided in two cast pieces joined together about the hinge tube or pivot tube by nuts on threaded studs, whereby the motor unit need not be disassembled to remove same from the hinge bracket.

1 Claim, 5 Drawing Figures

DIVIDED CAP HINGE BRACKET

BACKGROUND OF THE INVENTION

1. Field of the Invention

The present invention relates to devices for clamping a hinge tube or a pivot tube of an outboard electric motor unit in a selected vertical position along a length of the tube.

2. The Prior Art

U.S. Pat. No. 3,989,000, issued Nov. 2, 1976, to the present inventor, discloses a novel steering control system useful in an electric trolling motor of the prior art.

Prior art arrangements employing foldable, bow-mounted outboard electric trolling motors have employed one-piece, split-sleeve hinge brackets each of which receives a clamping screw in a transverse position, biasing the sides of the bracket together about the split opening. Tightening the screw clamps the bracket about a hinge or a pivot tube passing through the bore of the bracket and facilitates vertical adjustment of the motor. However, breakage of the hinge bracket, as from stresses thereon through the connections of lever arms used to move the motor between its propulsion and storage positions, from overtightening of the screw, from repeated small distortions of the bracket from clamping and unclamping forces, or from accident, requires that either the steering and power control head or the electric motor and propeller assembly must be physically disassembled from the pivot tube for replacement of the hinge bracket by removing the entire bracket over one end of the tube or the other.

A pertinent prior art device has been manufactured by the Pflueger Company, of Columbia, South Carolina, comprising an outboard electric trolling motor having a bow mounting comprising a U-channel lever arm connected to a heavy hinge bracket by a pin and a clamp. A front end of the hinge bracket has a semi-cylindrical recess therein with two pairs of bosses at upper and lower ends thereof threaded to receive bolts through a corresponding pair of semi-cylindrical retaining straps. A hinge tube of an outboard electric trolling motor is received through the bore formed by the hinge bracket and retaining strap parts. The heavy construction of the hinge bracket makes breakage thereof unlikely and reduces any necessity of replacing same.

SUMMARY OF THE INVENTION

In accordance with the principles of the invention, a 2-piece divided cap hinge bracket is engageable with a cylindrical hinge tube or a pivot tube of an outboard electric trolling motor unit, the hinge bracket engaging on one side thereof at least two lever arms for moving the motor and tube between a stored and an operating position. The hinge bracket comprises separable first and second parts each having a concave, half-cylindrical mating surface portion engageable with an outside surface of the hinge or the pivot tube. The first part carries the lever arms on one side thereof in a transverse relation to the axis of the concave mating surfaces. The inside surface of the bore formed by the first and second parts is serrated or roughened to increase transmission of clamping forces between surfaces of the parts and the tube without distortion of either. The second part forms a one-piece cap member which is clamped to the first part and about the hinge or pivot tube by four studs extending therethrough and four nuts threaded onto the ends of the studs.

THE DRAWINGS

THE PREFERRED EMBODIMENTS

Figures 1, 1A, 2, 3, 4:
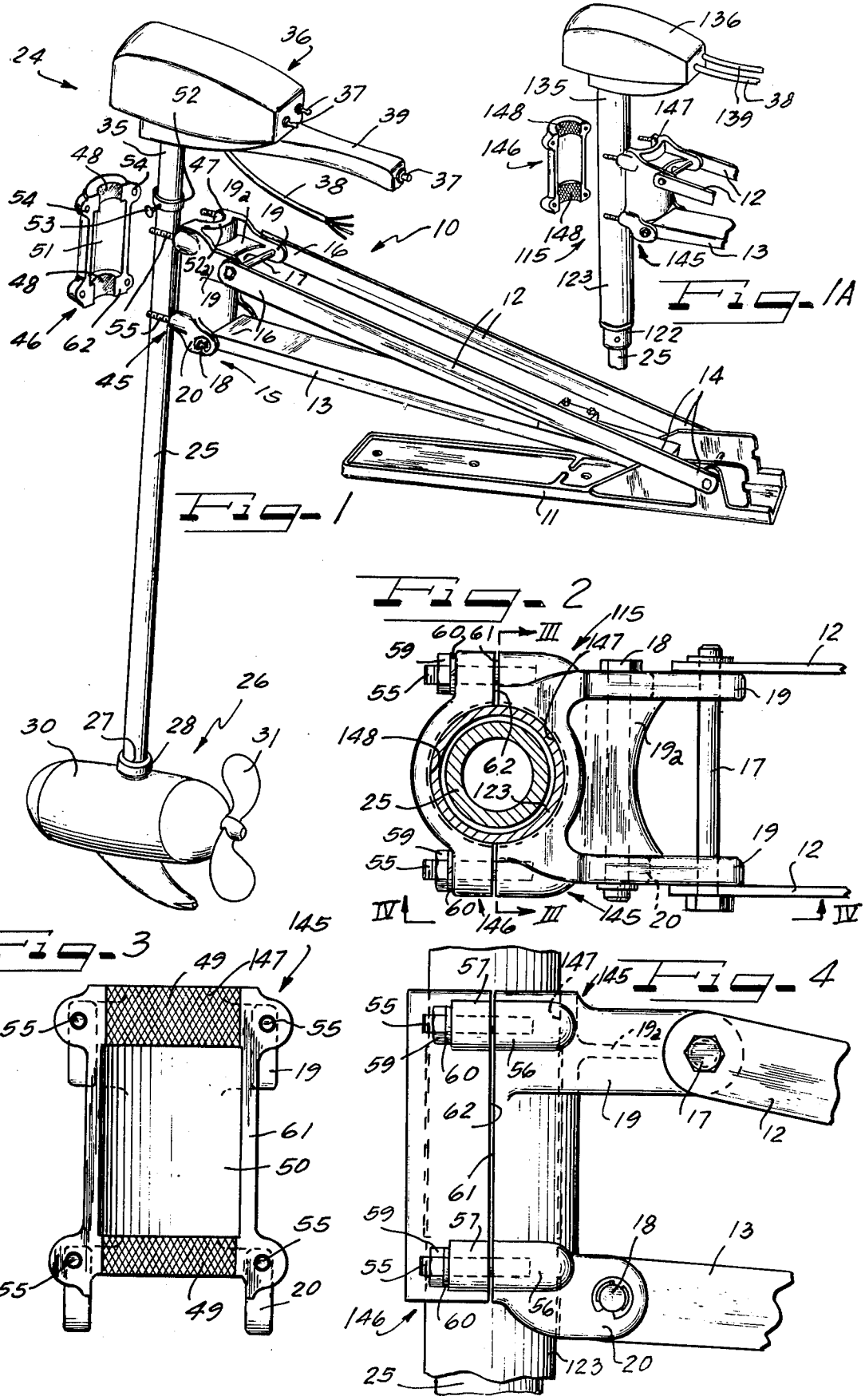
FIG. 1 is partly exploded perspective view of a tiller model outboard electric trolling motor employing the present invention.
FIG. 1A is a view similar to FIG. 1, showing a remote control model motor.
FIG. 2 is a top plan view of the divided cap hinge bracket of FIG. 1*a*, with hinge tube and pivot tube in section.
FIG. 3 is a front elevational view of the bracket part of the hinge bracket, taken on line III-III of FIG. 2.
FIG. 4 is a side elevational view of the assembled hinge bracket, on line IV-IV of FIG. 2.

By way of illustration, an outboard electric trolling motor assembly 10 adapted to be mounted on the bow of a boat (not shown) is shown generally in FIG. 1. Those skilled in the art could adapt the present invention to a stern mounting if desired. A bow bracket 11 is affixed to the deck of a boat such as a bass boat in the center thereof and just behind the bow. A plurality of upper and lower lever arms 12, 13 are pivotally engaged with the bow bracket 11 on first ends 14 thereof and to a divided cap hinge bracket 15 at opposite ends 16 thereof.

The hinge bracket 15 is connected to the lever arms 12, 13 by respective upper and lower pivot pins 17, 18 received transversely therethrough at respective upper and lower boss portions 19, 20. A flange **19*a* stiffens the upper bosses 19. The levers 12, 13 together with the connections at the bow bracket 11 and the hinge bracket 15 are arranged or configured to orient a pivot tube 25 of the motor unit 24 of the assembly 10 vertically and transversely to the base of the bow plate 11 in a forward position of the lever arms 12, 13, and in a horizontal position parallel to the base of the bow bracket 11 in a rearward, storage position of the motor unit 24**.

An electric motor and propeller assembly 26 is carried on a bottom end 27 of the pivot tube 25. The pivot tube 25 is affixed securely to a housing 30 of the assembly 26 as by a press-fit and is sealed at the bottom end by a water seal 28. A propeller 31 is arranged on an axis transverse to the pivot tube 25 and is rotatably driven by the motor of the assembly 26.

An upper end 35 of the pivot tube 25 in the tiller model of FIG. 1 engages a power and steering control head 36 carrying electric switches 37 for controlling the supply of electric power from a cable 38 to the motor 26. A tiller handle 39 is provided for manually controlling the orientation of the axis of the propeller 31 via a fixed press-fit connection between the control head 36 and the pivot tube 25.

In a remote control embodiment as shown in FIG. 1A, a motor unit 124 has a control head 136 press-fittingly engaged to an upper end 135 of a hinge tube 123. The control head 136 has electric power cables 38 and a remote steering control 139 running thereinto. In this remote control embodiment, the pivot tube 25 is carried rotatably in the hinge tube 123 on an upper bearing in the control head 136 and on a lower bearing 122 affixed to the pivot tube 25, as disclosed in the Foley U.S. Pat. No. 3,989,000. The control cable 139 operates any known steering control device, such as a rack mounted for reciprocation in engagement with a pinion gear affixed to the upper end of the pivot tube 25.

In accordance with the principles of the present invention, the motor unit 24 or 124 is connected with the boat via the pivot tube 25 or the hinge tube 123, the bow bracket 11, lever arms 12, 13 and the hinge bracket 15 or 115. The divided cap hinge bracket 15 or 115 is formed in first and second parts 45 and 46 or 145 and 146. Each part is formed with half of a cylindrical recess therein at 47 and 48 or 147 and 148 for cooperatively engaging the outer wall of the pivot tube 25 or the hinge tube 123, respectively. The surfaces 47, 48; 147, 148 are confined to upper and lower portions of the bracket parts 45, 46; 145, 146 as shown in FIGS. 1, 1A, and 3.

The surfaces 47, 48 of the bracket 15 are left rough from the casting process to ensure a snug engagement about the pivot tube 25 to allow the pivot tube 25 to be rotated therein via the tiller 39 while retaining the tube in a fixed position when no force is applied to the tiller 39. A collar 52 set about the pivot tube 25 and slidable therealong has a thumb nut and screw 53 extending radially through one side thereof for engagement with the pivot tube 25 at a selected longitudinal position. The collar 52 then fixes the vertical position of the motor unit 26 by bearing upon an upper surface 52*a* of the parts of the hinge bracket 15. The surfaces 147, 148 of the bracket 115 are left rough or are serrated as at 49 in FIG. 3 to enhance further the gripping forces and clamping action between the bracket parts 145, 146 and the hinge tube 123, to prevent rotation therebetween. Central portions 50, 51 of the interior portions of the bracket parts 45, 46; 145, 146 are recessed to avoid contacting the pivot tube 25 or the hinge tube 123 and also to lighten the structure while maintaining a desired rigidity therein.

The first and second bracket parts 45, 46; 145, 146 are joined together and aligned with one another by a plurality of studs 55 which are engaged in bosses 56 of the first, forward bracket part 45; 145. The studs 55 extend forwardly of the assembly 10 or 110, transverse to the axis of the pivot tube 25 or hinge tube 123 at each corner of the bracket part 45; 145. These positions of the bosses 56 and studs 55 transmit anchoring forces of the lever arms 12, 13 through the pins 17, 18 and the bosses 19, 20 directly to the pivot tube 25 or hinge tube 125 with minimum concentration of stresses in the part 45 or 145. The flange 19*a* extending between the bosses 19 reinforces the rearward part of the structure. The second, cap part 46; 146 of the hinge bracket 15; 115 is formed with corresponding boss members 57 which define apertures 54 and receive on a forward surface 58 thereof nuts 59 and lock washers 60 for clamping the parts 45 and 46 or 145 and 145 together about the pivot tube 25 or the hinge tube 123, respectively. Adjacent planar surfaces 61, 62 of the parts 45, 46; 145, 146 do not quite abut one another in either embodiment as shown in FIGS. 2 and 4, in order that a desired gripping force may be transmitted to the pivot tube 25 via the surfaces 47, 48 or to the hinge tube 123 via the surfaces 147, 148. However, the space between the surfaces 61, 62 is kept very small, so that the tube 25 or 123 cannot be distorted from its cylindric shape and the bracket parts 45, 46; 145, 146 will not be deformed or unduly stressed by even excessive clamping forces exerted by the nuts 59 and studs 55.

In use and in operation, in the tiller model of the motor, the pivot tube 25 with the collar 52 thereon is first assembled with both the electric motor and propeller assembly 26 and the steering and power control head 36 to form the motor unit 24. The bow bracket 11 is then assembled with the lever arms 12, 13 and the rear bracket part 45 of the hinge bracket 15. Final assembly of the pivot tube 25 with the hinge bracket 15 is then readily effected by placing the tube 25 into the half-cylindrical recess 47 of the part 45 and the hinge cap 46 onto the studs 55 via the apertures 54 provided through the bosses 57 thereon. The nuts 59 are screw tightened against the surfaces 58 of the bosses 57 with the pivot tube 25 in a desired vertical position. The collar 52 is engaged with the upper surfaces 52*a* of the bracket 15 and the nut 53 is tightened. The vertical position of the pivot tube 25 together with the propulsion and control units 26, 36 thereon may be adjusted at any time merely by loosening the thumb nut 53 in either the storage or the propulsion position of the motor assembly 10. Generally, a greater submersion of the propeller 31 increases its efficiency but also somewhat increases drag due to the larger submerged area of the pivot tube 25. Usually a selected adjustment once effected will be maintained unless the boat is used in different waters or if the unit 10 is disassembled for maintenance or storage. The hinge bracket 15 may readily be replaced upon failure thereof by simply removing the cap 46 and the pins 17, 18 and substituting a new bracket, without disassembly of the units 26, 36 from the pivot tube 25.

In the remote control model of the motor, the hinge tube 123 is first press-fitted into the base of the steering and power control head 136. Then the pivot tube 25 is inserted through the hinge tube 123 and the bearing 122 is fitted along the shaft thereof to engage against the bottom of the hinge tube 123 to accommodate the control devices located in the control head 136. The motor unit 124 is then assembled to the hinge bracket 115 as in the tiller model, but with the control head 136 aligned in a fore-and-aft position with respect to the lever arms 12, 13. Vertical positioning of the motor unit 124 is effected by loosening the nuts 59 on the studs 55 and repositioning the hinge tube 123 vertically within the hinge bracket 115.

Although various minor modifications may be suggested by those versed in the art, it should be understood that I wish to embody within the scope of the patent warranted hereon all such modifications as reasonably and properly come within the scope of my contribution to the art.

I claim as my invention:

1. For use with a bow-mounted electric trolling motor unit of the type comprising an elongate cylindrical hinge tube extending downwardly from a control head and through which extends a rotatable pivot tube having an electric motor and propeller assembly carried on a lower end thereof for steering and propelling a boat selectively at low speed, an improved divided cap hinge bracket comprising:

a bow mounting means having a first cast bracket part, having a semi-cylindrical body portion and spaced apart upper and lower boss portions on said bracket part and projecting therefrom in one direction, each boss portion apertured to receive and support respective upper and lower pivot pins extending transversely between the spaced apart boss portions, a flange extending from said semi-cylindrical body portion and disposed transversely between said upper boss portions and attached to each said upper boss portion, to strengthen said bracket, a plurality of lever arms pivotally connected to said boss portions for hingedly swinging said first bracket part between a folded storage position on the bow of said boat and a vertical upright position, said first bracket having a second side thereof formed with a pair of upper and lower semi-cylindrical mating surfaces left rough from casting to form serrated abrasive abutment gripping surfaces for engaging the adjoining surfaces of said hinge tube in a non-rotatable firm assembly, and each having a corresponding flat abutment surface at the end thereof, studs affixed in said first bracket part and each projecting out of one of said flat abutment surfaces in a direction opposite to said one direction, a second cast bracket part also having corresponding flat abutment surfaces, said second bracket part apertured at said corresponding flat abutment surfaces and receiving said studs, nuts received on said studs over said second bracket part for selectively clamping the parts together in assembly about said hinge tube with the respective upper and lower serrated abrasive surfaces defining a cylindric bore for clampingly engaging the hinge tube, said bore having a slightly smaller diameter than said hinge tube such that a small gap exists between said flat abutment surfaces of said first bracket part and said second bracket part when said hinge tube is within said bore and said nuts are fully tightened on said studs, whereby the pivot tube may be selectively assembled with and removed from the hinge bracket without disassembly of the control head or the electric motor and propeller assembly.

* * * * *